United States Patent [19]

Coggin, Jr. et al.

[11] 4,203,559

[45] May 20, 1980

[54] PRECISION WINDER FOR THE DRAWING AND PACKAGING OF SYNTHETIC FIBERS

[75] Inventors: Charles H. Coggin, Jr., Upland; Tatsuo R. Sakakura, Gardena, both of Calif.

[73] Assignee: Nitto Boseki Co., Ltd., Tokyo, Japan

[21] Appl. No.: 880,634

[22] Filed: Feb. 23, 1978

Related U.S. Application Data

[63] Continuation-in-part of Ser. No. 810,430, Jun. 27, 1977, abandoned.

[51] Int. Cl.[2] ..... B65H 54/08; B65H 59/38

[52] U.S. Cl. ..... 242/18 G; 242/18 R; 242/18 CS; 242/45

[58] Field of Search ..... 242/18 G, 18 CS, 18 R, 242/45, 75.51, 75.52

[56] References Cited

U.S. PATENT DOCUMENTS

| | | | |
|---|---|---|---|
| 2,140,555 | 12/1938 | Satterlee | 242/18 CS |
| 2,509,250 | 5/1950 | Roberts | 242/45 |
| 3,717,311 | 2/1973 | Smith | 242/18 CS X |
| 3,801,032 | 4/1974 | Sears et al. | 242/18 G X |
| 3,838,827 | 10/1974 | Klink et al. | 242/18 CS X |
| 3,854,668 | 12/1974 | Rudd | 242/18 CS |
| 4,076,181 | 2/1978 | Coggin, Jr. | 242/18 G |

*Primary Examiner*—Stanley N. Gilreath
*Attorney, Agent, or Firm*—Naylor, Neal & Uilkema

[57] ABSTRACT

A precision winder having a traverse mounted in a fixed position and a spindle mounted for rectilinear movement away from the traverse in response to the growth of a package being formed on the spindle. The spindle is driven by a D.C. motor and a D.C. speed control is provided to control the speed of the motor in response to movement of the spindle away from the traverse. The main control potentiometer for the speed control is linear and adjusted in response to movement of the spindle away from the traverse by a cam proportioned to effect non-linear adjustment of the potentiometer at a rate proportional to the decrease in spindle speed required to maintain drawing speed constant as the package grows.

3 Claims, 6 Drawing Figures

FIG. 1.
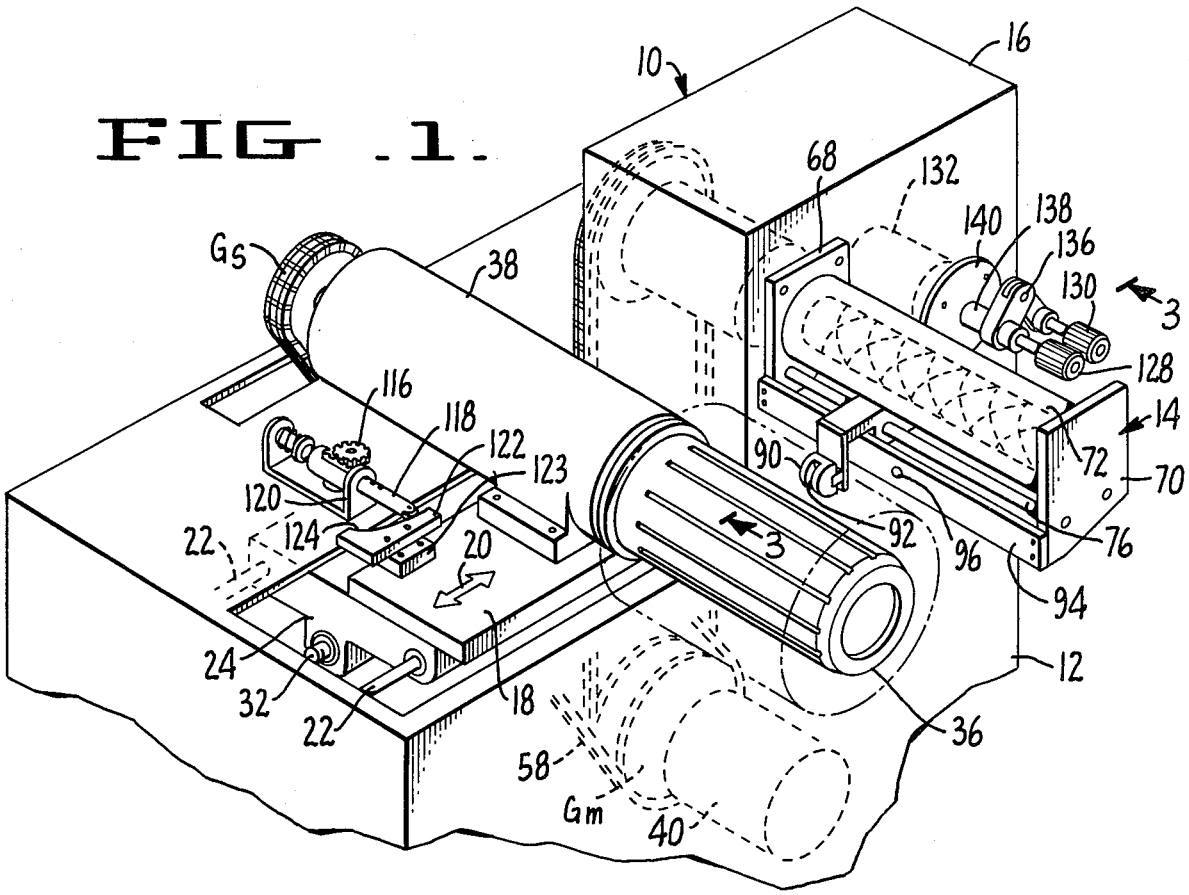
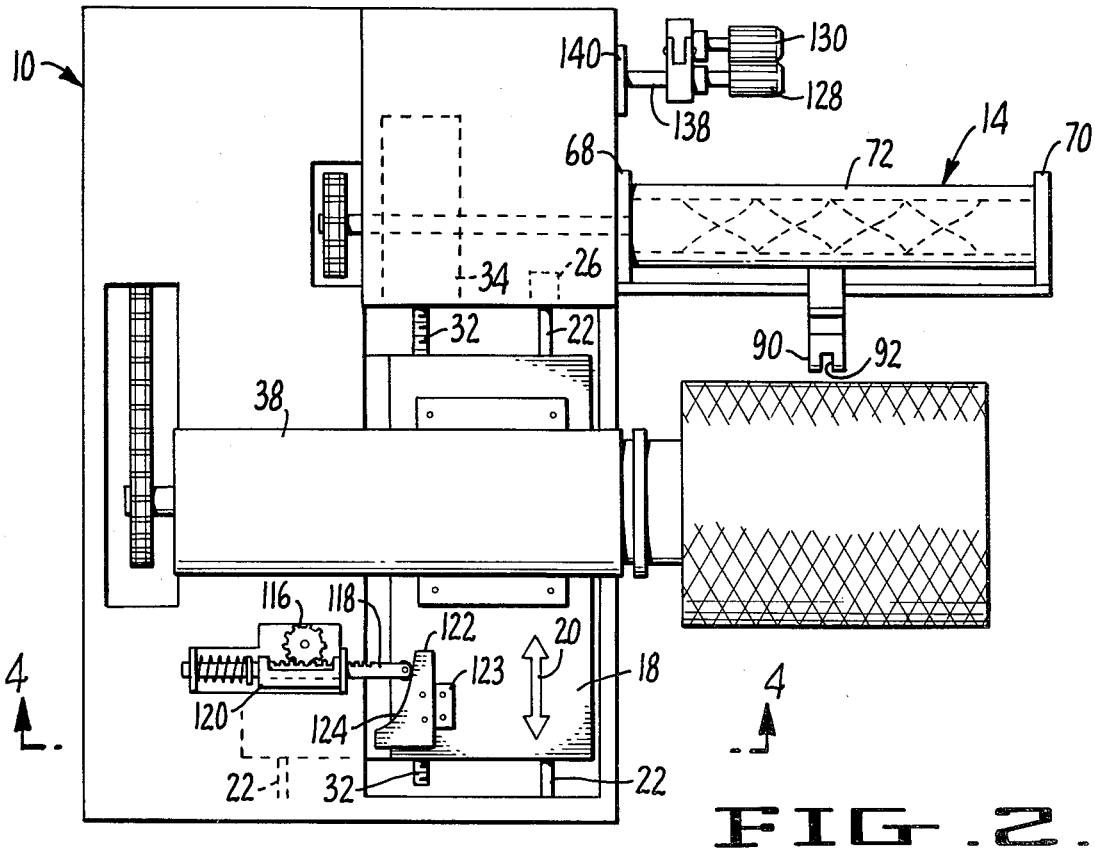
FIG. 2.

| Δr | Y | ΔY |
|---|---|---|
| 0 | .6109 | 0 |
| .25 | .7827 | .1718 |
| 1.00 | 1.1760 | .5651 |
| 1.50 | 1.3690 | .7581 |
| 2.00 | 1.5250 | .9141 |
| 2.50 | 1.6537 | 1.0428 |
| 3.00 | 1.7618 | 1.1509 |

PRECISION WINDER FOR THE DRAWING AND PACKAGING OF SYNTHETIC FIBERS

RELATED APPLICATIONS

This application is a continuation-in-part of our copending application Ser. No. 810,430, filed June 27, 1977, now abandoned.

The subject of the present invention also relates to that forming the subject of copending application Ser. No. 735,000, filed on Oct. 22, 1976, now U.S. Pat. No. 4,076,181, by Charles H. Coggin, Jr., one of the co-inventors herein.

BACKGROUND OF THE INVENTION

The present invention relates to the drawing of synthetic fiber, such as glass fiber, and is particularly concerned with a winder which enables such fibers to be directly drawn into a precision package and provides a constant drawing speed to effect uniform fiber attenuation. The invention is especially directed to such a winder which is ideally suited for use with high-capacity nontip bushings of the type disclosed in U.S. Pat. No. 3,905,790. Such bushings enable the drawing of sufficiently large quantities of fiber that roving operations may be done away with.

The prior art relating to winders of the type with which the present invention is concerned is believed best exemplified by U.S. Pat. Nos. 3,547,361, 3,819,122 and 3,897,021. The U.S. Pat. no. 3,547,361 discloses a direct winder wherein a programmed control system is employed to maintain constant strand speed as the package being formed grows. The U.S. Pat. No. 3,819,122 discloses a direct winder wherein the traverse is fixed and the spindle is mounted for rectilinear movement toward and away from the traverse. The U.S. Pat. No. 3,819,122 is also significant in that the traverse guide is mounted on a support rod and in that a programmer is provided to slow down the speed of the spindle as the diameter of a package being formed on the spindle increases. The '021 patent is significant in that it discloses a direct winder wherein the traverse is mounted for rectilinear movement relative to the spindle and wherein a control is provided to control spindle speed in response to the sensed size of a package being formed. U.S. Pat. No. 2,972,450 is of interest in that it shows that textile winding machines have also been provided with control means to maintain a constant winding speed as the size of the package being formed grows. In the case of the U.S. Pat. No. 2,972,450 a mechanical disc drive reduces speed in response to package growth.

Although the above-discussed patents are significant, they do not disclose or suggest the improved features of the present invention. In particular, these patents do not suggest the simplified mechanically coupled D.C. motor control employed in the present invention.

SUMMARY OF THE INVENTION

The spindle drive control of the invention employs a D.C. motor coupled in driving engagement with the spindle, a D.C. speed control electrically coupled to the motor, and a linear speed command potentiometer electrically coupled to the speed control and mechanically coupled to the spindle through a cam operator proportioned to effect non-linear adjustment of the potentiometer at a rate proportional to the decrease in spindle speed required to maintain drawing speed constant as a package grows. This arrangement provides for automatic adjustment to maintain the peripheral speed of a package on the spindle substantially constant as the spindle moves away from the traverse in response to growth of the package. Constant peripheral speed of the spindle results in uniform fiber drawing and attenuation and the resultant formation of fibers having a uniform diameter.

A principal object of the invention is to provide a direct winder wherein the peripheral speed of the package being formed is maintained substantially constant through the provision of a D.C. motor control mechanically coupled to a movable support table for the spindle of the winder.

Another and related object is to provide a mechanical coupling arrangement wherein non-linear control is achieved through means of a linear control potentiometer.

Another and more specific object is to provide such a mechanical coupling arrangement wherein the non-linear control is effected through a replaceable cam which may be readily changed to accommodate different drawing conditions.

Yet another and more general object is to provide D.C. motor control for a direct winder which is adapted to provide constant drawing speed without the employment of a complicated and expensive speed control programmer.

The foregoing and other objects will become more apparent when viewed in light of the following detailed description and accompanying drawings.

BRIEF DESCRIPTION OF THE DRAWINGS

FIG. 1 is a perspective view of the winder of the present invention, showing parts thereof in phantom line representation;

FIG. 2 is a plan view of the upper portion of the winder;

DESCRIPTION OF THE PREFERRED EMBODIMENT

Figure 4:
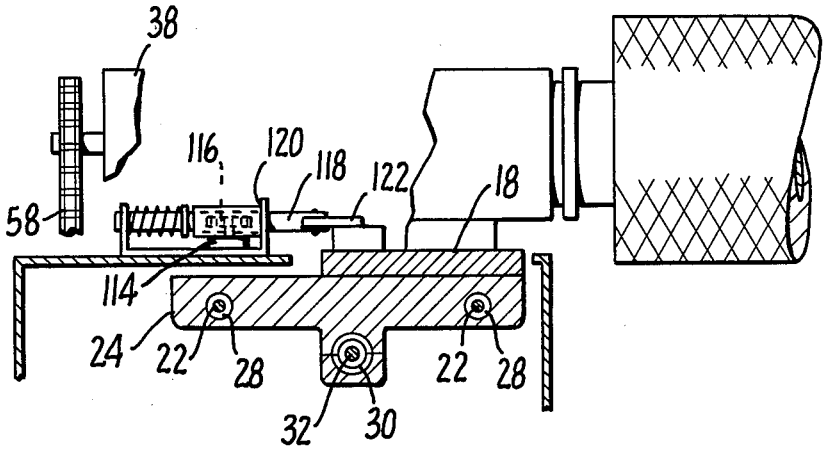
FIG. 4 is a cross-sectional view taken on the plane designated by line 4—4 of FIG. 2.

Referring now to FIG. 1, the winder is designated therein in its entirety by the numeral 10. The base element of the winder comprises a pedestal 12 which supports all of the winder structure. A traverse 14 is fixedly mounted to one side of the pedestal 12 through means of an extension 16 forming part of the pedestal. A table 18 is mounted on the pedestal to one side of the extension 16 for slidable movement relative to the pedestal in a rectilinear path extending normal to the traverse 14. The arrow line 20 indicates that direction of movement of the table.

The table 18 is mounted for slidable movement relative to the pedestal 12 by a pair of rods 22 fixed to the pedestal beneath the table. Mounting brackets 24 and 26 are fixedly secured to the underside of the table 18 and slidably received on the rods 22 through means of bushings 28. The bracket 24 carries a nut 30 threadably received on a screw 32 driven by a reversible D.C. motor 34 (See FIG. 5). The motor 34 will hereinafter be referred to as the spindle table motor. The screw 32 extends parallel to the rods 22 and, thus, rotation of the screw in one direction functions to move the table 18 away from the traverse 14 and rotation in the opposite direction functions to move the table toward the traverse.

A spindle 36 is mounted on the table 18 in parallel apposition to the traverse 14. The spindle is mounted for rotation about its longitudinal axis through means of a journal 38 secured to and carried by the table 18.

The traverse 14 and spindle 36 are driven by a D.C. motor 40 mounted in the pedestal 12. The motor 40 is mounted so that its output shaft, designated 42, extends parallel to the spindle and the traverse. Cable chain drives couple the motor in driving relationship to the traverse and the spindle. The cable chain drive for the traverse comprises a spur gear 44 mounted on the motor shaft 42; a spur gear 46 mounted on the drive shaft, designated 48, of the traverse; and, a cable chain 50 trained around the spur gears 44 and 46. The cable chain drive for the spindle 36 comprises a spur gear Gm mounted on the motor shaft 42; a spur gear Gs mounted on the drive shaft, designated 56, for the spindle; and, a cable chain 58 trained around the spur gears Gm and Gs. Although not illustrated, it should be understood that the cable chain 58 is provided with a suitable resilient tensioning device in order that the chain may accommodate movement of the spindle toward and away from the traverse. Such a tensioning device might take a form similar to that used for the belt drive disclosed in aforementioned copending application Ser. No. 735,000.

The traverse 14 comprises: a barrel cam 60 having helical cam grooves 62 formed in the surface thereof; a support shaft 64 concentrically keyed to the cam 60 and the shaft 48 to couple the shaft 48 in driving relationship to the cam; a journal 66 mounted within the extension 16 and rotatably supporting the shafts 48 and 64; a pair of end plates 68 and 70 disposed to either end of the barrel cam 60 and having mounted therebetween a generally cylindrical housing 72 disposed in spaced concentric relationship to the cam, said housing having a longitudinal extending slot 74 extending therethrough over the length of the bottom of the housing; a pair of rods 76 and 78 supported by and extending between the end plates 68 and 70 in spaced parallel relationship to one another, said rods, as viewed from the end of the barrel cam (See FIG. 3), being disposed to either side of the slot 74; a traverse guide 80 having bores 82 slidably received on the rods 76 and 78; a follower 86 carried by the guide 80 and extending upwardly therefrom into engagement with the helical cam groove 62, said follower being of a width less than that of the groove 74; a leaf spring 88 secured to and extending downwardly from one end of the guide 80 in apposition to the spindle 36; a guide shoe 90 carried by the free end of the spring 88, said shoe having a vertically extending groove 92 formed therein for guiding engagement with a bundle of filaments being directed onto the spindle (See FIG. 3); a plate 94 mounted on and extending longitudinally between the end plates 68 and 70 in apposition to the rear side of the leaf spring 88, said plate having an aperture 96 extending therethrough at a position disposed midway between the end plates 68 and 70; and, an oscillator 98 supported by the plate 94 to the rear of the aperture 96.

In the preferred embodiment, the guide 80 is a unitary monolithic element fabricated of a plastic, such as nylon or one of the many high-strength polymers. The use of such plastic material has the advantage that it minimizes the weight of the guide and, thus, the inertial forces which result from its movement. It also permits the bores 82 to be formed directly in the guide, without the necessity of bushing inserts. The follower 86 is provided with a metallic tip for engagement in the groove 62. The portion of the follower which extends through the groove 74 may be fabricated of a plastic material, similar to that of the guide 80.

In use, the barrel cam is continuously driven in unison with the spindle 36 by the motor 40. Driving of the cam functions to traverse the guide 80 back and forth across the length of the cam and, in turn, to move the guide shoe 90 and any filaments engaged thereby across the spindle 36. During such movement, all torsional forces imparted to the guide 80 are transmitted to the rods 76 and 78. Thus, wobbling of the guide and its associated elements is substantially eliminated and wear to the cam grooves 62 is minimized.

The arrangement of the guide shoe 90 is similar to that disclosed in aforementioned copending application Ser. No. 735,000 in that the shoe is held out of engagement with the peripheral surface of the package, designated 100, on the spindle 36 by the tension in the strand of filaments, designated 102, being wound. This arrangement enables the guide shoe to be held very close, but just off the surface of the package 100, by the tautness of the strand 102, thus allowing for precision placement of the strand, without the contacting of the package by the shoe. As the package diameter increases, the strand 102 pushes the shoe toward the plate 94 against the resilient biasing of the spring 88.

The oscillator 98 is of the r.f. type (proximity switch) and may take any commercially available form, such as those manufactured by the Honeywell Micro Switch Division of Honeywell, Inc., and identified as type "FY." The positioning of the oscillator is such that the leaf spring 88 is normally outside the field of the oscillator, but enters the field upon being depressed to a predetermined degree by the tension in the strand being wound. When the spring enters the field of the oscillator, it changes the amplitude of the oscillator and this change is detected and employed to energize the spindle table motor 34 to move the spindle away from the traverse by a predetermined relatively small increment. Such movement moves the spring 88 out of the field of the oscillator 98 until such time as the package on the spindle again grows to a point where the tension in the strand being wound moves the spring back into the field of the oscillator.

Figure 5:
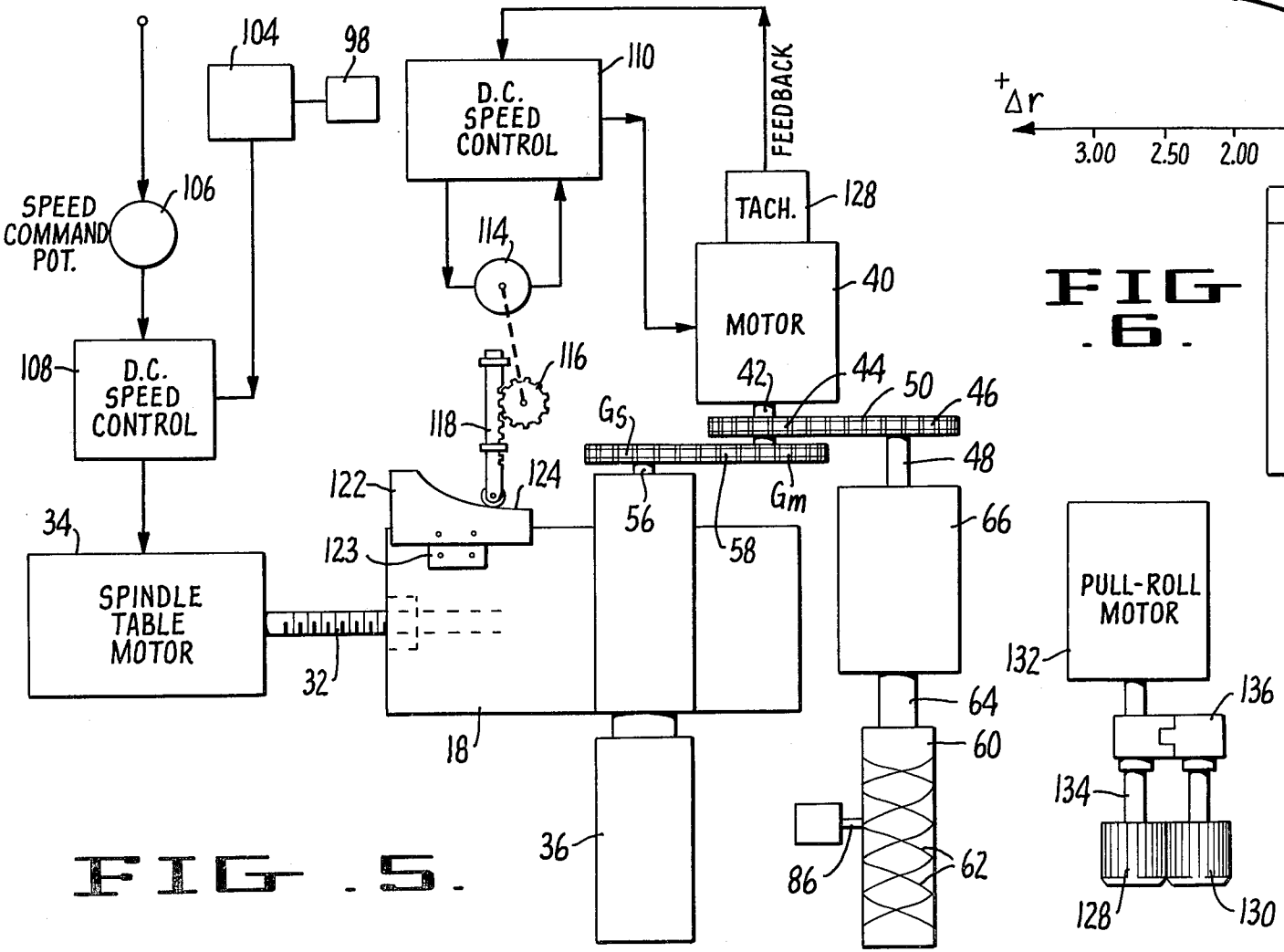
FIG. 5 is a plan view diagrammatically illustrating the winder and the control mechanism and circuitry therefor, including the pull roll motor; and, FIG. 6 is a tabulation and curve showing an example of a cam curve calculated and constructed according to the present invention.

The control circuitry for the spindle table motor 34 is diagrammatically illustrated in FIG. 5 and comprises, in addition to the oscillator 98, a detection and delay circuit 104; a speed command potentiometer 106 and a D.C. speed control 108. The detection and delay circuitry and the associated speed control circuitry may take any conventional form. In use, the speed control is set at a relatively low speed during the incremental advance mode controlled by the oscillator 98 and circuit 104. The speed control would be set at a high speed during the override mode employed at the commencement of winding of a package when it is desired to reverse the spindle motor to return the spindle to a start-up position closely adjacent the traverse.

The motor 40 is provided with a D.C. speed control 110 whereby the speed of the motor may be selectively varied to, in turn, control the speed of the traverse 14 and spindle 36. The control 110 may be of any suitable commercially available type, such as Model PC-198 manufactured by Minarik Electric Company of Los Angeles, Calif. Such controls incorporate adjustable minimum and maximum speed potentiometers which set speed limits and are used in association with a main speed control potentiometer to selectively control speeds within these limits. As incorporated into the system of the present invention, the main speed control potentiometer takes the form of an adjustable rotary potentiometer 114 mounted on the top of the pedestal 12 and operated through the following elements: a spur gear 116 mounted on the potentiometer shaft; a gear rack 118 engaged with the spur gear and slideably mounted on the top of the pedestal 12 by a bracket 120; and a cam plate 122 mounted on the table 18 and having the cam surface 124 engaged by a follower 126 on the rack 118. The rack gear 118 is guided by the bracket 120 for axial movement toward the cam and a spring normally biases the rack gear so that its follower engages the cam surface 124. The cam plate is mounted on the table 18 for select adjustment relative thereto by a slide 123.

In operation, incremental movement of the table 18 in response to growth a package on the spindle adjusts the main speed control potentiometer through means of the above described operating structure. This adjustment, in turn, adjusts speed of the motor 40 to maintain constant the peripheral speed of the package being formed on the spindle. Thus, speed control is automatically maintained through mechanical means, without the necessity of programmed controllers or direct sensing of package size. A tachometer 128 is coupled to the motor for providing a feedback signal to the control 110.

The winder of the present invention also includes a pair of pull rolls 128 and 130 mounted on the extension 16 and driven by a motor 132 mounted within the extension. The motor 132 drives the roll 128 through a shaft 134 and the roll 130 is supported in meshed engagement with the roll 128 by a toggle mechanism 136. The mechanism 136 is supported on a sleeve 138 having a base plate 140 secured to the extension 16. The shaft 134 extends through the plate 14 and sleeve 138 for rotation relative thereto. The toggle mechanism 136 is resiliently biased and permits the roll 130 to be swung out of engagement with the roll 128.

The purpose of the pull roll mechanism is to provide means whereby the strand being drawn from the bushing of a furnace may be pulled during periods when winder operation is interrupted. The mechanism differs from prior art mechanisms primarily in that it is mounted directly on the winder. Similar mechanisms are found in the prior art, but these generally are mounted separately from the winder.

Figure 3:
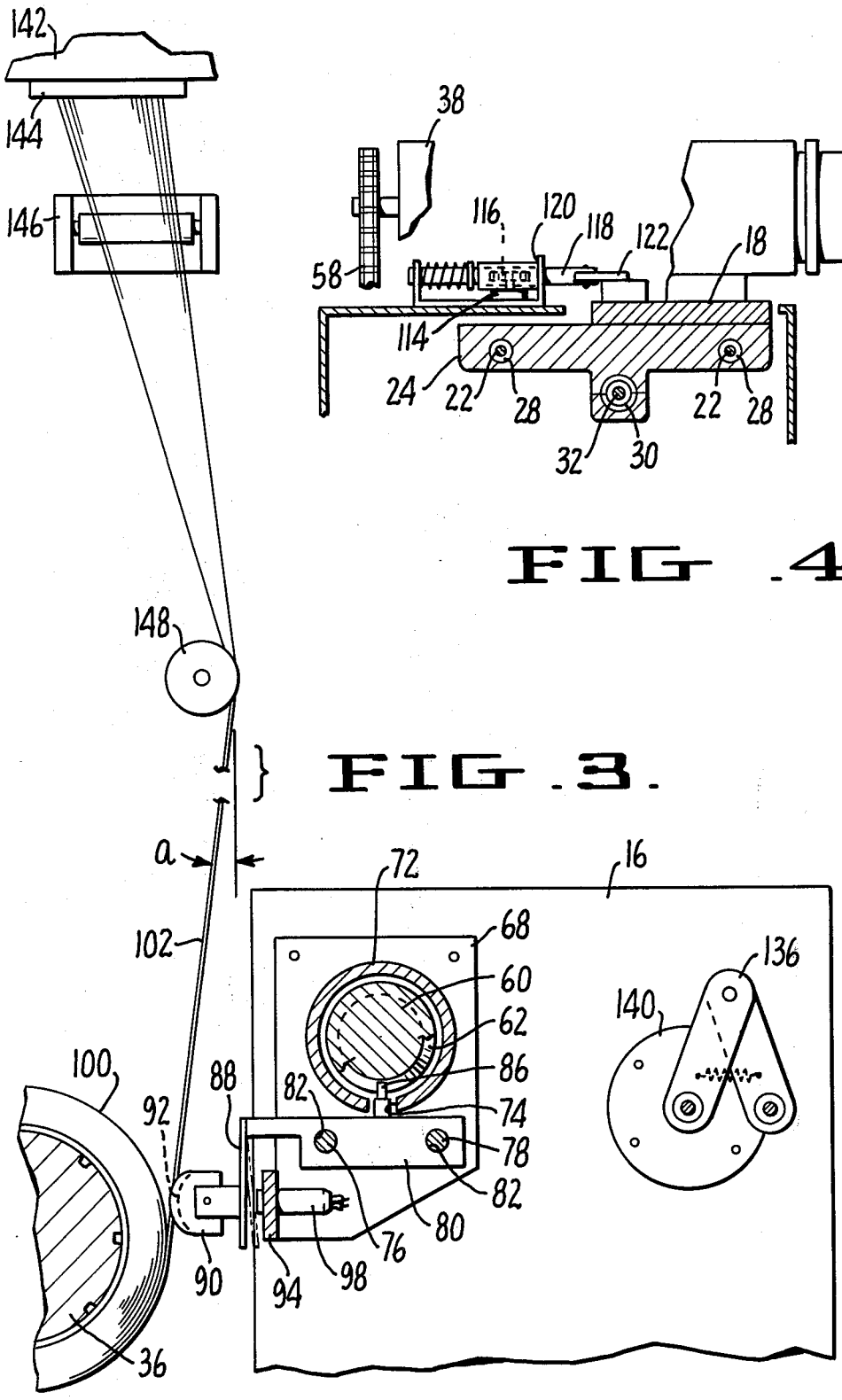
FIG. 3 is a cross-sectional view, taken on the plane designated by Line 3—3 of FIG. 1, diagrammatically illustrating the position which the winder assumes relative to a bushing from which fibers are being directly drawn by the spindle of the winder.

FIG. 3 shows the winder in the position which it would assume relative to a furnace from which glass fiber filaments are being drawn. As there shown, the furnace forehearth is designated by the numeral 142 and a bushing assembly 144 is shown disposed at the undersurface of the forehearth. Preferably, the bushing 142 is of the nontip, high-orifice density type disclosed in U.S. Pat. No. 3,905,790. The high output of such bushings ideally suits them for direct winding operation, as relatively large rovings are provided directly from the bushings. The structure shown in FIG. 3 is completed by a sizing applicator 146 and a gathering shoe 148. From FIG. 3, it will also be appreciated that the winder of the present invention maintains constant the angle, designated a, which the strand 102 assumes relative to the gathering shoe.

CALCULATION OF CAM CURVE FOR CONTROL POTENTIOMETER

The purpose of the cam 122 is to adjust the potentiometer 114 so that the peripheral speed of the package being formed on the spindle is maintained constant. This results in constant linear velocity of fiber being drawn and resultant uniform fiber attenuation and size.

To achieve the above purpose the cam must adjust the potentiometer in a non-linear fashion to accommodate for the non-linear increase in drawing speed which would result from package growth if the spindle were driven at a constant speed.

Working with the basic criteria that peripheral package speed is to be maintained constant as the package grows, the equations for calculating the shape of the cam surface are derived as follows:

Strand Speed Equation:

$V = \pi DW$ Where: $V$ = Linear Strand Speed, inches/minute; $D$ = Package Dia., inches; $W$ = Angular Velocity of Collet, RPM; $r$ = Package Radius, inches; $k$ = Constant If:

$V_o = \pi D_o W_o$ Where: $V_o$ = Initial Strand Speed; $D_o$ = Initial Package Dia.; $W_o$ = Initial Angular Velocity of Collet; $r_o$ = Inside radius of Package Then:

$\pi D_o W_o = \pi DW = K$ or:

$r_o w_o = rW$

Therefore:

$$W = \frac{r_o}{r}(w_o) \qquad \text{EQ. \#1}$$

Resistance Equation With A Rotary Adjustable Linear Potentiometer

Where: $R$ = Resistance; $N$ = Turns through which Potentiometer is Rotated; $l_1$ = Resistance/turn $$R = l_1 N \qquad \text{EQ \#2}$$

Circular Motion Equation

Where: $Y$ = Cam Displacement, inches; $N$ = Turns through which Potentiometer is rotated; $D_p$ = Pitch Diameter of -continued Circular Motion Equation Potentiometer Drive gear (116)

$Y = D_pN$ EQ #3

Resistance as a Function of Cam Displacement Equation

From EQ #2 and EQ #3:

$R = l_1N$ (EQ #2)

$Y = \pi D_pN$ (EQ #3)

Substituting EQ #3 int. EQ #2:

$$R = l_1\left(\frac{Y}{\pi D_p}\right) = \frac{l_1}{\pi D_p}Y$$

Where: $l_2 = \frac{l_1}{\pi D_p}$ $R = l_2Y$ EQ #4

D.C. Motor/Controller Characteristic Equations $Wm = l_3R + b$ EQ #5

Where: $W_m$ = Motor Speed, RPM
R = Resistance
($l_3$ and b are established based on actual data established by measurements. They are dependent on the maximum/minimum speed potentiometer settings in the D.C. Speed Control.)

From EQ #4:

$R = l_2Y$

Combining EQ #4 and EQ #5:

$Wm = l_3(l_2Y) + b = l_3l_2(Y) + b$

Since $l_2 = \frac{l_1}{\pi D_p}$ $$Wm = \left(\frac{l_3l_1}{\pi D_p}\right)Y + b$$ EQ #6

Equation for Spindle RPM as a Function of Cam Displacement $$W_s = \frac{Gm}{Gs}Wm$$

Where: Ws = Spindle RPM
Gm = Gear Size for Drive Motor (ie. number of teeth on gear Gm)
Gs = Gear Size for Spindle Drive Gear (ie. number of teeth on gear Gs)

$$Ws = \frac{Gm}{Gs}\left[\left(\frac{l_3l_1}{\pi D_p}\right)Y + b\right]$$ EQ #7

EXAMPLE OF CAM CURVE CALCULATION USING EQUATIONS

Using EQ #7:

$$W_s = \frac{Gm}{Gs}\left[\left(\frac{l_3l_1}{\pi D_p}\right)Y + b\right]$$

Experimentation Indicated that:

$Ws = -351.6Y + 1055$

Using EQ #1:

-continued

EXAMPLE OF CAM CURVE CALCULATION USING EQUATIONS $$Ws = \frac{r_o}{r}(W_o)$$

Where: Ws = Spindle RPM
$r_o$ = Inside radius of package
r = Package radius
$W_o$ = Starting RPM (Initial Angular Velocity of Collet)

In the Above Equation:

Let $r_o = 3.2275$ in.

For 377 yards/pound product, $W_o = 840$ rpm

Therefore:

$$W_s = \frac{(3.2275)(840)}{r} = \frac{2711.1}{r}$$

The Resulting Simultaneous Equations:

$$W_s = \frac{2711.1}{r}$$

$W_s = -351.6Y + 1055$

Combining and Rearranging:

$$Y = \frac{-7.7107508}{r} + 3.000$$ EQ #8

Package Radius at Any Given Point in Time:

$r = r_o + \Delta_r$

Where: r = radius at any given point in time
$r_o$ = Inside radius of package
$\Delta_r$ = Increase in package radius as a result of running the given time.

Therefore:

$r = 3.2275 + \Delta_r$

Using EQ #8:

$$Y = -\frac{7.7107508}{3.2275 + \Delta r} + 3.000$$ EQ #9

Figure 6:
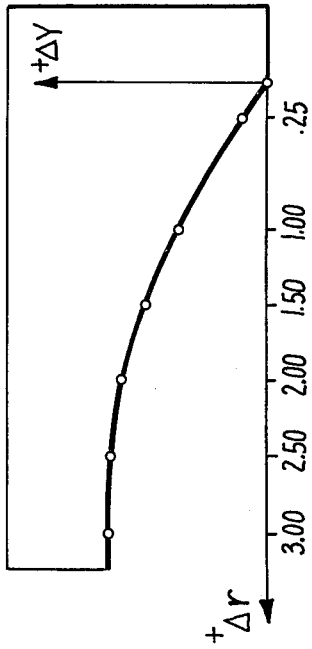

Using EQ #9, the tabulation and curve of FIG. 6 can be obtained for the above example. The resulting curve is the curve used for cutting the cam surface 124 of the plate 122.

Conclusion

From the foregoing detailed description, it is believed apparent that the invention enables the attainment of the objects initially set forth herein. It should be understood, however, that the invention is not intended to be limited to the specifics of the illustrated embodiment, but rather is defined by the accompanying claims.

What is claimed is:

1. A winder for directly drawing glass fiber from an orifice plate to form a precision wound package, said winder comprising: a traverse mounted in a fixed position, said traverse having a guide disposed for back and forth movement thereacross in a generally rectilinear path; a spindle disposed in parallel relationship to the rectilinear path of the guide; means mounting the spindle for rectilinear movement toward and away from the traverse while maintaining the relative parallel relationship of the spindle with the rectilinear path of the guide, a sensor to sense the distance between the traverse and the peripheral surface of a package of windings on the spindle; motion imparting means coupled to the spindle to move the spindle away from the traverse, said motion imparting means being operatively associated with the sensor to maintain a substantially constant distance between the traverse and the peripheral surface of windings on the spindle; a D.C. motor coupled in driving engagement with the spindle; a D.C. speed control electrically coupled to the D.C. motor to selectively vary the speed of the motor; a linear response speed command potentiometer, wherein the resistance change for each equal increment of potentiometer adjustment is the same, electrically coupled to the D.C. speed control; a cam carried by the means mounting the spindle for rectilinear movement, said cam being disposed for movement with said means and having an operating surface configured so as to provide an unequal increment of movement of the potentiometer for each equal increment of package diameter growth to maintain drawing speed constant as the package grows; a follower engaged with the operating surface of the cam for movement responsive thereto as the mounting means for the spindle moves rectilinearly in response to package growth; and means coupling the follower to the potentiometer to adjust the potentiometer in response to the movement of the follower.

2. A winder for directly drawing glass fiber from an orifice plate to form a precision wound package, said winder comprising: a spindle disposed to draw fiber from the orifice plate; a traverse disposed to guide the fiber back and forth across the spindle to form a package thereon; means mounting the spindle and traverse for movement relative to one another to maintain a substantially constant spaced relationship between the traverse and a package on the spindle; a D.C. motor coupled in driving engagement with the spindle; a D.C. speed control electrically coupled to the motor to selectively vary the speed of the motor; a linear response speed command potentiometer for the speed control, wherein the resistance change for each equal increment of potentiometer adjustment is the same; a cam and follower disposed for movement relative to one another in response to relative movement of the spindle and traverse as a package grows, said cam having a follower operating surface configured so as to provide an unequal increment of movement of the potentiometer for each equal increment as package diameter growth to maintain drawing speed constant as the package grows; and means coupling the follower to the potentiometer to adjust the potentiometer in response to growth of the package whereby relative movement of the cam and follower in response to package growth maintains drawing speed constant.

3. A winder for forming a wound package from an elongate strand, said winder comprising; a spindle disposed to draw the strand into a wound package; a traverse disposed to guide the strand back and forth across the spindle; means mounting the spindle and traverse for movement relative to one another to maintain a substantially constant spaced relationship between the traverse and a package on the spindle; a D.C. motor coupled in driving engagement with the spindle; a D.C. speed control electrically coupled to the motor to selectively vary the speed of the motor; a linear response speed command potentiometer for the speed control, wherein the resistance change for each equal increment of potentiometer adjustment is the same; a cam and follower disposed for movement relative to one another in response to relative movement of the spindle and traverse as a package grows, said cam having a follower operating surface configured so as to provide an unequal increment of movement of potentiometer for each equal increment of package diameter growth to maintain drawing speed constant as the package grows; and means coupling the follower to the potentiometer to adjust the potentiometer in response to growth of the package whereby relative movement of the cam and the follower in response to package growth maintains drawing speed constant.

* * * * *